United States Patent [19]

Stonehouse

[11] Patent Number: 5,010,671

[45] Date of Patent: Apr. 30, 1991

[54] FLIP CHART PAD

[75] Inventor: David R. Stonehouse, Mississauga, Canada

[73] Assignee: Dennison Stationery Products Company, Milford, Mass.

[21] Appl. No.: 381,831

[22] Filed: Jul. 19, 1989

Related U.S. Application Data

[63] Continuation of Ser. No. 121,794, Nov. 13, 1987, abandoned.

[51] Int. Cl.[5] ..... G09F 7/12

[52] U.S. Cl. ..... 40/594; 281/21.1; 281/15.1

[58] Field of Search ..... 40/594, 595, 600, 618, 40/530; 281/21.1, 15.1; 428/43

[56] References Cited

U.S. PATENT DOCUMENTS

| | | | |
|---|---|---|---|
| 413,147 | 10/1889 | Perry | 434/413 |
| 848,680 | 4/1907 | Nelson | 281/21.1 |
| 2,586,039 | 2/1952 | Heggedal | 40/594 |
| 3,778,324 | 12/1973 | Lavigne | 281/21.1 |
| 4,250,642 | 2/1981 | Riehle | 40/160 |
| 4,652,239 | 3/1987 | Brimberg | 434/80 |
| 4,670,794 | 6/1987 | Araki et al. | 358/293 |
| 4,741,119 | 5/1988 | Baryla | 40/594 |

FOREIGN PATENT DOCUMENTS

| | | | |
|---|---|---|---|
| 111183 | 6/1984 | Japan | 40/594 |

OTHER PUBLICATIONS

Post-It Notes ©1985.

*Primary Examiner*—Gene Mancene
*Assistant Examiner*—Michael Lynch
*Attorney, Agent, or Firm*—Arthur B. Moore

[57] ABSTRACT

In a flip-chart comprising at least two sheets disposed in overlying relationship and releasably securable to one another by means of static cling, each said sheet adapted for writing thereon and erasure of said writing, and each said sheet being removeable from said other sheets for releasable securement to a surface soley by means of static cling.

26 Claims, 1 Drawing Sheet

FLIP CHART PAD

This application is a continuation of application Ser. No. 07/121,794, filed 11/13/87, now abandoned.

FIELD OF INVENTION

This invention relates to a flip-chart pad and particularly relates to a flip-chart pad utilizing a plurality of tear sheets each releaseably securable to a surface solely by mean of static cling.

BACKGROUND TO THE INVENTION

Various devices have heretofore been developed in connection with displaying information during a presentation, a seminar, or for advertisement or the like.

For example, white boards having a vertical surface presenting a smooth white surface for writing thereon have heretofore been used. Such white boards usually comprise a board of wood, particle board or other like material which has one side finished with a smooth white surface for writing thereon with a felt pen or the like, and which writing is erasable by a dry brush or tissue s that the white board can be reused. Such white boards are generally expensive to make and require fasteners such as screws or the like to fasten the white board to a vertical surface.

Other arrangements such as paper pads including advertising display pads as disclosed in U.S. Pat. No. 2,755,576 have been used for displaying certain advertising information. The advertising display pad disclosed in U.S. Pat. No. 2,755,576 generally relates to a removeably adhesive supportable advertising display pad which is adapted to be secured adhesively to an irregularly contoured support.

Furthermore, other devices have been used in the past which utilize electrostatic attraction for securing materials to a surface. For example, French patent no. 76 36888 discloses that a notice in a window or other display position is made up of regular geometric shapes carrying blocks of information which when arranged together convey a particular message.

Moreover, Japanese patent no. 111183 discloses a sheet which is bonded to an object by electrostatic action by rubbing the surface of the object to be bonded. Such sheets having adequate adhesiveness to the objects to be bonded and ar highly transparent.

Finally, British patent no. 627881 teaches that thin sheets of polyvinyl chloride when made with a highly glazed surface will cling very firmly to a glossy surface.

It is an object of this invention to combine the benefits of white boards with those of a traditional paper pads.

It is a further object of this invention to provide for a flip-chart pad which is more economical to produce and easily transportable.

The broadest aspect of this invention relates to a flip-chart comprising at least two sheets disposed in overlying relationship and releaseably securable to one another by means of static cling, each said sheet adapted for writing thereon and erasure of said writing, and each said sheet being removeable from said other sheets for releaseable securement to a surface soley by means of static cling.

It is another aspect of this invention to provide a flip-chart pad comprising a plurality of overlying tear sheets releaseably attracted to one another by means of static cling so as to define said pad, each said sheet adapted for writing thereon and for dry erasure of said writing for reuse of said sheet, and each said sheet being removeable from said pad for releaseable securement to a surface solely by means of static cling.

It is another aspect of this invention to provide a flip-chart pad comprising; a plurality of overlying tear sheets capable of generating static cling, each said sheet adapted for writing thereon with a felt pen, and for dry erasure of said writing; a bristol board backing adapted to support said plurality of overlying tear sheets, said backing including a folded edge adapted to overlie a portion of said tear sheets; fastening devices presented in the region of said folded edge of said backing so as to fasten said overlying tear sheets between said folded edge and said backing, so as to define said pad; each said tear sheet adapted to be removeable from said pad for releaseable securement to a surface solely by means of static cling.

DESCRIPTION OF DRAWINGS

These and other objects and features shall now be described in greater detail in connection with the following drawings.

DESCRIPTION OF THE INVENTION

Like parts will be given like numbers throughout the figures.

Figure 1:
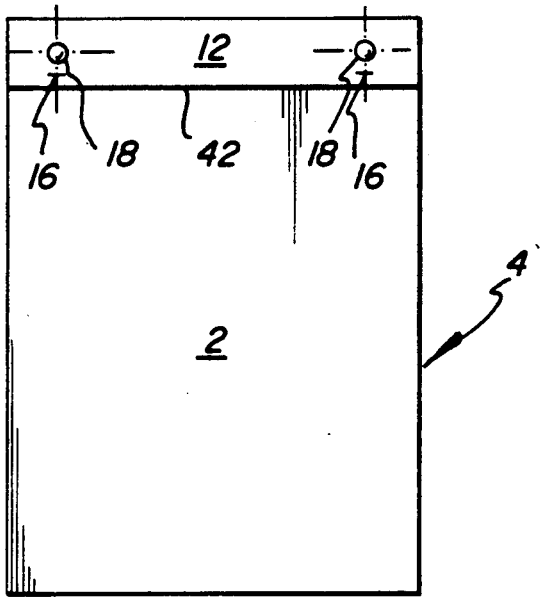
FIG. 1 is a top plan view of the flip-chart pad.
Figure 2:
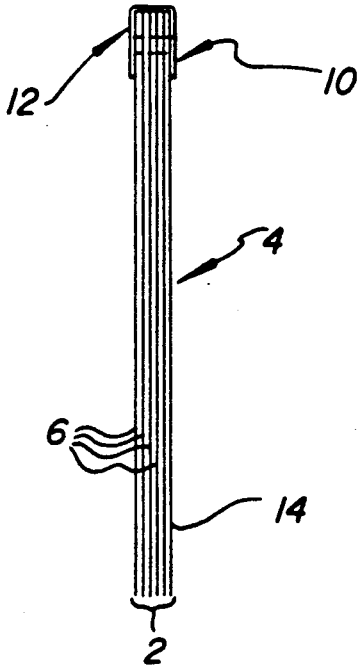
FIG. 2 is a side elevational view of the flip-chart pad.

FIGS. 1 and 2 illustrate a plurality of overlying tear sheets 2 which define a pad 4. Any number of tear sheets 2 may be used although as a practical matter at least two tear sheets 2 would normally be utilized.

The plurality of tear sheets 2 are adapted to cling to one another by means of static cling. Such action tends to unitize the plurality of tear sheets 2 as they are attracted to one another so as to define a flip-chart pad 4.

Each tear sheet 6 from the plurality of tear sheets 2 comprise of material capable of generating static cling. It has been found that sufficient static forces are generated when each tear sheet 6 has a thickness between one and three thousandths of an inch; and generally good results are exhibited when the thickness of each tear sheet 6 is in the vicinity of two thousandths of an inch.

Furthermore, in the preferred embodiment each tear sheet 6 comprises of oriented polypropylene film, and particularly good static cling characteristics have been experienced by utilizing polypropylene film sold by Mobil Chemical Company, Putsford, N.Y. under the trade marks Oppalyte and Bicor. The "Oppalyte" trade mark film presents a white surface for writing thereon, while the "Bicor" trade mark film presents a clear transparent surface.

More particularly the polypropylene film sold under the trade mark Oppalyte has the following characteristics:

| Trade Mark Designation | Description | Approximate Thickness (Microns) | Approximate Yield ($m^2$/kg.) |
|---|---|---|---|
| OPPalyte 350 TW | high opacity white core, non-heat sealable, modified OPP two sides | 38.1 | 49.8 |
| OPPalyte 278 TW | high opacity white core, non-heat sealable, modified OPP two sides | 50.8 | 39.6 |
| OPPalyte 233 TW | high opacity white core, non-heat sealable, modified OPP two sides | 63.5 | 33.2 |
| OPPalyte 220 TW | high opacity white core, non-heat sealable, modified OPP two sides | 50.0 | 32.0 |

Particularly good results are exhibited through the use of OPPalyte 278 TW.

Furthermore transparent sheets having the following characteristics have exhibited good static cling characteristics:

| Trade Mark Designation | Description | Approximate Thickness (Microns) | Approximate Yield ($m^2$/kg.) |
|---|---|---|---|
| Bicor 240 B | non-sealable, unmodified homopolymer polypropylene | 32.0 | 34.1 |

Other film or sheets 6 which have exhibited good static cling characteristics are:

(a) polyester film sold by ICI America, Inc., Wilmington, Del. under the trade mark Melinex which is a polyethylene terephtharate (Pet) polymer, (b) vinyl film sold by ICI America, Inc., Wilmington, Del. under the trade mark Mela sheet.

Each sheet 6 is adapted for writing thereon by means of a pen, felt pen or the like. In the preferred embodiment a felt pen may be used to write information on the sheet 6. The information written on the sheet 6 is erasable by a brush, tissue paper or the like, when the ink is still wet or even when the ink is dry. In other words, each sheet 6 is dry erasable so as to be capable of reuse.

Figure 3:
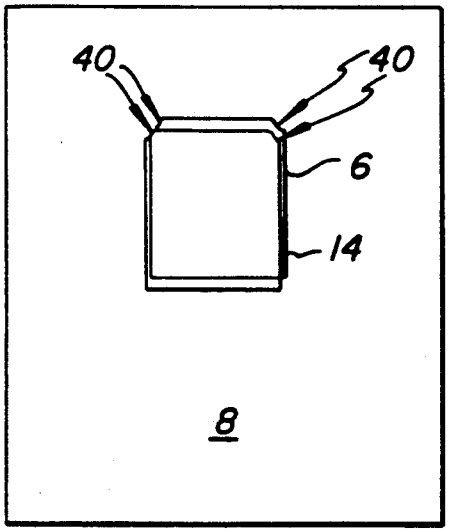
FIG. 3 is front elevational view of a surface illustrating one tear sheet releaseably secured to a vertical surface by means of static cling and a transparent sheet overlying the tear sheet which is releaseably secured to the tear sheet and surface by static cling.

Each tear sheet 6 is adapted to be removeable from the pad 4 for releaseable securement to a surface by means of static cling as best illustrated in FIG. 3. Each tear sheet 6 is self-adherent to most surfaces by means of static cling. If the surface 8 is such that the sheet 6 is not capable of retention thereto by static cling no securement will occur. In other words the static cling forces generated between the sheet 6 and surface 8 must be great enough to overcome the gravitational forces exerted on the sheet 6. For example, it has been found that tear sheet 6 made of vinyl best adhere to smooth surfaces, while sheet 6 made of polypropylene film adhere to surfaces commonly used for walls which are either painted, wallpapered, or drywalled.

Therefore the user of the flip-chart pad 4 may either write upon the top sheet 6 of pad 4 and then remove such sheet 6 for releaseable securement or adhesion to a wall 8 by means of static cling, and then continue writing on the fresh sheet 6 exhibited on flip-chart pad 4; or the user may first remove a tear sheet 6 from pad 4 to place the sheet 6 on the wall 8 for securement by means of static cling and then write on the sheet 6. Before writing on the tear sheet 6, four to five strokes of the hand smoothing out the sheet 6 on the surface 8 will increase the static cling charge and allow the tear sheet 6 once removed from the flip-chart pad 4 to self-adhere to the wall surface without tape or tacks. In this manner the tear sheet 6 may be used in the same fashion as a white board but with considerable cost savings as well as being able to secure the sheet 6 to a wall 8 without the need of tape fasteners or the like.

Furthermore, since the tear sheet 6 is adapted to be dry erasable any writing on the tear sheet 6 may be erased so as to enable the user to reuse same.

The flip-chart pad 4 may also include a backing sheet or cover stock 10 for supporting the plurality of overlying sheets 2 as best illustrated in FIG. 2. The backing 10 presents a folded edge 12 which is adapted to overlie a portion of the overlying tear sheets 2. Staples 16 are presented in the region of the folded edge portion 12 so as to fasten the plurality of tear sheets 2 between the folded edge 12 and backing 10 so as to define the flip-chart pad 4. The backing sheet may be made of any suitable material such as for example bristol board. Furthermore the backing sheet 10 may overlie only a portion of the tear sheets 2 so as for example to be similar in size and extent to the folded edge 12 as illustrated in FIGS. 1 and 2; or backing 10 may be coextensive with the tear sheets 2 (not shown).

Each tear sheet 6 may be removed from the stapled pad by sharply pulling downward on each tear sheet 6 so as to tear the tear sheet 6 away from the flip-chart pad 4 and particularly away from the staples 16.

The flip-chart pad 4 illustrated in FIG. 2 also includes a transparent film 14 disposed between the plurality of overlying tear sheets 2 and backing 10. The transparent film 14 is also adapted to be capable of generating static cling so as to cling to the plurality of tear sheets 2 as well as being adapted to be removed from the flip-chart pad 4 for securement to a wall surface 8 by means of static cling.

In a particular advantageous application the transparent film 14 may be adapted to overlie a tear sheet 6 which has adhered to a wall surface 8 by means of static cling so as to allow the user to show interaction of information included on the transparent film 14 with information included on tear sheet 6, or to permit the user to write on the transparent film 14 while overlayed over the tear sheet 6 so as not to mark up the information included on tear sheet 6.

The flip-chart pad 4 also includes apertures 18 through folded edge 14, plurality of tear sheets 2, transparent film 14 and backing 10 for receiving hooks or the like (not shown) so as to hang the flip-chart pad 4 from a suitable surface. Furthermore in one particular embodiment the staples 16 are located below apertures 18 so as to present a design weakness in the tear sheets thus faciliting the removal of the tear sheets 6 from the flip chart pad 4.

By tearing tear sheets 6 from pad 4 torn corners 40 are presented which represent the material left in the pad 4 between staples 16 and the corners of the tear sheets 6 located in the region of the folded portion 12. In one particular embodiment of the invention tear sheets 16 are heat sealed together along edge 42 in a manner so that tear sheet 6 will "tear" along a straight line 42 so as to eliminate the presence of any torn corners 40. Such heat sealing may be accomplished by utilizing sealing bars or ultrasonic welding which welds the film 6 together by agitating the molecules of the sheets 6 and generating heat for welding.

Figure 4:
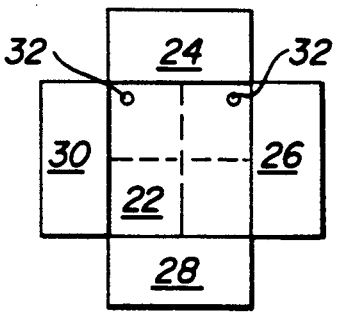
FIG. 4 is a top plan view of a corrugated package in an opened and closed position utilized to package said flip-chart pads.

The flip-chart pad 4 may be shipped in a corrugated package 20 best illustrated in FIG. 4. The corrugated package 20 comprises a back support 22 and flaps 24, 26, 28 and 30 which are adapted to move from an open position as illustrated in FIG. 4 so a to permit insertion of a flip-chart 4 therein to a closed position as illustrated by the phantom lines in FIG. 4 for shipment. Corrugated package 20 also includes holes 32 which may be adapted to hold flip-chart pad 4 by means of the apertures 18. Furthermore the corrugated package 22 may be used as a backing for the flip-chart pad 4 by removing the flaps 24, 26, 28 and 30.

It has been found that the best results occur when the plurality of tear sheets 2 include the following characteristics:

(a) whiteness of sheets;
(b) static generation and cling retention; and
(c) erasability.

The plurality of tear sheets 2 may also be adapted to be permanently fastened together in a colouring book form so as to present caricatures or designs adapted to be filled in by children with felt pens. Each sheet 2 could then be erased for reuse as a colouring book at a later date.

In another embodiment each sheet 6 may also include advertising material printed thereon and adapted to be placed on a transparent surface such as a glass or the like for securement thereto by means of static cling. For example, such sheet 6 may include advertising material and have particular advantages for use for the sale of new or used cars as the sheet 6 could be placed against the inside of the front window of a ca for securement thereto by static cling for advertising the price and financing features of the used car. Such adaptation would eliminate the need to paint such information on the outside surface of a front window of a new or used car.

Although the preferred embodiment as well as the operation and use has been specifically described in relation to the drawings it should be understood variations in the preferred embodiment could easily be achieved by a man skilled in the art without departing from the invention. Accordingly, the invention should not be understood to be limited to the exact form revealed in the drawings.

The embodiments of the invention in which an exclusive property or privilege is claimed are defined as follows:

1. In a flip-chart pad comprising a plurality of overlying tear sheets releaseably attracted to one another by means of static cling so as to define said pad, each said sheet adapted for writing thereon and for dry erasure of said writing for reuse of said sheet, and each said sheet being removeable from said pad for releaseable securement to a surface solely by means of static cling.

2. In a flip-chart pad comprising:

(a) a plurality of overlying tear sheets capable of generating static cling, each said sheet adapted for writing thereon with a felt pen, and for dry erasure of said writing;
(b) a backing adapted to support said plurality of overlying tear sheets, said backing including a folded edge adapted to overlie a portion of said tear sheets;
(c) fastening means presented in the region of said folded edge for releaseably fastening said tear sheets between said folded edge and said backing so as to define said pad; and
(e) each said tear sheet adapted to be removable from said pad for releaseable securement to a surface solely by means of static cling.

3. In a flip-chart pad as claimed in claim 2 wherein said tear sheets are between one and three thousandths of an inch thick.

4. In a flip-chart pad as claimed in claim 3 wherein said tear sheets comprise polyester film.

5. In a flip-chart pad as claimed in claim 3 wherein said tear sheets comprise vinyl film.

6. In a flip-chart pad as claimed in claim 3 wherein said tear sheets comprise polyethylene terephtharate polymer.

7. In a flip-chart pad as claimed in claim 3 wherein said tear sheets comprise oriented polypropylene film.

8. In a flip-chart pad as claimed in claim 7 wherein said pad also includes one transparent film disposed between said plurality of overlying tear sheets and said backing, said transparent film capable of generating static cling and adapted to be removeable from said pad for releaseable securement to a surface by means of static cling and for releaseable securement over a tear sheet releaseably secured to a surface.

9. In a flip-chart pad as claimed in claim 8 wherein said fastening means comprises staples.

10. In a flip-chart pad as claimed in claim 9 wherein said pad includes aligned apertures in said folded edge, said tear sheets, said transparent film, and said backing for hanging said pad.

11. In a flip-chart as claimed in claim 10 wherein said tear sheets are welded together in the region adjacent said folded edge, each said tear sheet adapted to tear along said weld.

12. A kit comprising said flip-chart pad as defined in claim 10 and including a corrugated package for packaging said flip-chart pad, said corrugated package including means for attaching said pad to said package.

13. A flip-chart pad comprising at least two sheets of oriented polypropylene film having a high opacity white core disposed in overlying relationship and releasably securable to one another by means of static cling; each said sheets removable from said other sheets for releasable securement to a surface solely by means of static cling wherein each said sheets is capable of receiving markings thereon with dry wipe inks and of substantially fully removing said markings by dry erasure means for reuse of said sheet whether in said flip-chart pad or on said surface.

14. A flip-chart pad as defined in claim 13, where the oriented polypropylene film is Mobil Chemical OPPalyte® film.

15. A flip-chart comprising a plurality of overlying sheets of oriented polypropylene film having a high opacity white core and at least one transparent sheet, each said sheets releasably attracted to one another by means of static cling so as to define said flip-chart pad; each of said sheets removable from said pad for releasable securement to a surface solely by means of static cling wherein each said sheets is capable of receiving markings thereon with dry wipe inks and of substantially fully removing said markings by dry erasure means for reuse of said sheet whether in said flip chart-pad or on said surface.

16. A flip-chart pad as defined in claim 15, where the oriented polypropylene film is Mobil Chemical OPPalyte® film.

17. A flip-chart pad as defined in claim 16, wherein the transparent sheet comprises Mobil Chemical Bicor® film.

18. A flip-chart pad comprising:

(a) a plurality of opaque overlying tear sheets of oriented polypropylene film, each of said tear sheets being capable of generating static cling, of receiving markings thereon with dry erase ink, and of substantially complete removal of said markings by dry erasure means;

(b) a cover folded over a portion of said tear sheets so as to support said tear sheets; and (c) fastening means for fastening said tear sheets to said cover so as to define said pad, wherein each of said tear sheets is removable from said pad for releasable securement to a surface solely by means of static cling.

19. A flip-chart pad as claimed in claim 18 wherein said tear sheets are between one and three thousandths of an inch thick.

20. A flip-chart pad as claimed in claim 18 wherein said opaque tear sheets have a high opacity white core.

21. A flip-chart pad as claimed in claim 20 wherein said fastening means comprises staples.

22. A flip-chart pad as defined in claim 18, further comprising a transparent polypropylene tear sheet fastened to said cover, said transparent tear sheet being capable of generating static cling and of releasable securement to a surface after removal from said cover, and further being capable of receiving markings with dry erase inks and of substantially complete removal of said markings by dry erasure means.

23. A flip-chart pad as claimed in claim 22 wherein said pad includes aligned apertures in said folded cover, said opaque tear sheets, said transparent tear sheet film, for hanging said pad.

24. A flip-chart pad as claimed in claim 18 wherein said tear sheets are welded together in the region adjacent said folded edge, each said tear sheet adapted to tear along said weld.

25. A flip-chart pad as defined in claim 18, wherein the polypropylene film is Mobil Chemical OPPalyte® film.

26. A flip-chart pad comprising at least two sheets of opaque white film disposed in overlying relationship and releasably securable to one another by means of static cling; each of said sheets being removable from said other sheets for releasable securement to a surface solely by means of static cling, wherein each of said sheets is capable of receiving markings thereon with dry wipe inks and of substantially fully removing said markings by dry erasure means for reuse of said sheets whether in said flip-chart pad or on said surface.

* * * * *